US006457198B1

(12) United States Patent
Jones

(10) Patent No.: US 6,457,198 B1
(45) Date of Patent: Oct. 1, 2002

(54) PORTABLE GOLF BALL CLEANING DEVICE

(76) Inventor: Robert Jones, 2512 Fairbanks Ct., Naperville, IL (US) 60540

( * ) Notice: Subject to any disclaimer, the term of this patent is extended or adjusted under 35 U.S.C. 154(b) by 0 days.

(21) Appl. No.: 09/780,333

(22) Filed: Feb. 9, 2001

(51) Int. Cl.[7] ..... A63B 47/04
(52) U.S. Cl. ..... 15/21.2
(58) Field of Search ..... 15/21.2, 97.1; 224/274

(56) References Cited

U.S. PATENT DOCUMENTS 1,730,973 A * 10/1929 Henrizi
1,991,183 A * 2/1935 Sundahl
2,540,687 A * 2/1951 Netterstrom
2,744,274 A * 5/1956 Procario et al.
3,099,027 A * 7/1963 Illo
3,210,789 A * 10/1965 Garrett
3,740,784 A * 6/1973 Moprrissey
3,748,676 A * 7/1973 Warren et al.
3,981,039 A * 9/1976 Rumph
4,403,366 A * 9/1983 Lucke
4,442,564 A * 4/1984 Berry
4,464,072 A * 8/1984 Norwell
5,647,082 A * 7/1997 Garske et al.
5,758,379 A * 6/1998 Hovnanian
6,095,934 A * 8/2000 Ohama
6,202,911 B1 * 3/2001 Freer

* cited by examiner

*Primary Examiner*—Terrence R. Till
(74) *Attorney, Agent, or Firm*—Goldstein & Lavas, P.C.

(57) ABSTRACT

A portable golf ball cleaning device including a housing having a hollow interior. The housing has an opening therein exposing the hollow interior. The opening is dimensioned for receiving a golf ball therethrough. The housing has a plurality of bristles disposed thereon on an interior surface thereof. The hollow interior holds a quantity of a soap and water solution therein. A ball receiving portion is rotatably disposed within the hollow interior of the housing. The ball receiving portion is dimensioned for receiving the golf ball therein. The ball receiving portion is positioned within the hollow interior of the housing whereby a golf ball positioned therein will be in contact with the plurality of bristles of the housing.

4 Claims, 2 Drawing Sheets

PORTABLE GOLF BALL CLEANING DEVICE

BACKGROUND OF THE INVENTION

The present invention relates to a portable golf ball cleaning device and more particularly pertains to allowing a golf ball to be cleaned by a golfer at any location on a golf course.

The game of golf has quickly become one of this country's favorite activities. A typical golf course is comprised of eighteen individual holes, with each hole including a tee box and a green. On most golf courses, the tee box is the location for ball washers, machines which are used to clean golf balls. Most golfers will use these machines to clean their golf ball prior to beginning the next hole. A clean golf ball is always desired when playing so as to avoid potential problems when striking the golf ball. Once a golfer reaches the green, he is allowed to mark the position of the golf ball on the green in order to clean the ball prior to putting. Typically, the golfer will use a towel in order to clean the ball. When the ball requires water to further clean the ball, the golfer will tend to use their own saliva because a ball washer is not convenient. Because chemicals and the like are more prevalent in treating the grass on golf courses, it is advisable not to make contact with the golf ball with the mouth. Thus, it is becoming necessary to have the ability to clean a golf ball at any location on a golf course.

The present invention attempts to solve the abovementioned problem by providing a portable golf ball cleaning device that can be carried by a golfer or attached to their golf bag to allow a golf ball to be cleaned at any location on a golf course.

The use of golf ball cleaning devices is known in the prior art. More specifically, golf ball cleaning devices heretofore devised and utilized for the purpose of cleaning golf balls are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, the aforementioned patents do not describe a portable golf ball cleaning device for allowing a golf ball to be cleaned by a golfer at any location on a golf course.

In this respect, the portable golf ball cleaning device according to the present invention substantially departs from the conventional concepts and designs of the prior art, and in doing so provides an apparatus primarily developed for the purpose of allowing a golf ball to be cleaned by a golfer at any location on a golf course.

Therefore, it can be appreciated that there exists a continuing need for a new and improved portable golf ball cleaning device which can be used for allowing a golf ball to be cleaned by a golfer at any location on a golf course. In this regard, the present invention substantially fulfills this need.

SUMMARY OF THE INVENTION

In the view of the foregoing disadvantages inherent in the known types of golf ball cleaning devices now present in the prior art, the present invention provides an improved portable golf ball cleaning device. As such, the general purpose of the present invention, which will be described subsequently in greater detail, is to provide a new and improved portable golf ball cleaning device which has all the advantages of the prior art and none of the disadvantages.

To attain this, the present invention essentially comprises a housing having a generally circular configuration. The housing has a planar front wall, a planar rear wall, a peripheral side wall therebetween, and a hollow interior. The peripheral side wall has an opening therein exposing the hollow interior. The opening is dimensioned for receiving a golf ball therethrough. The peripheral side wall has a plurality of bristles disposed thereon on an interior surface thereof. The housing has a base secured thereto to support the housing in upright orientation. The base is diametrically opposed from the opening in the peripheral side wall. The hollow interior holds a quantity of soap and water solution thereon. A ball receiving portion is rotatably disposed within the hollow interior of the housing. The ball receiving portion includes a cup portion disposed within the hollow interior of the housing. The cup portion has an open upper end and a closed lower end. The open upper end is dimensioned for receiving the golf ball thereon. The cup portion is positioned within the hollow interior of the housing whereby a golf ball positioned within the open upper end thereof will be in contact with the plurality of bristles of the housing. The ball receiving portion includes a stem portion extending downwardly from the closed lower end of the cup portion. The ball receiving portion includes an axle extending between the front and rear walls of the housing within the hollow interior thereof. The axle is coupled with a free end of the stem portion. The ball receiving portion includes a handle portion disposed on the front wall of the housing. The handle portion is coupled with the axle to facilitate rotation thereof. A tee holding bracket is secured to the front wall of the housing. The tee holding bracket is adapted for holding a plurality of golf tees. A towel clip is secured to the peripheral side wall of the housing. The towel clip is adapted for securing to a towel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable golf ball cleaning device which has all the advantages of the prior art golf ball cleaning devices and none of the disadvantages.

It is another object of the present invention to provide a new and improved portable golf ball cleaning device which may be easily and efficiently manufactured and marketed.

It is a further object of the present invention to provide a new and improved portable golf ball cleaning device: which is of durable and reliable construction.

An even further object of the present invention is to provide a new and improved portable golf ball cleaning device which is susceptible of a low cost of manufacture with regard to both materials and labor, and which accordingly is then susceptible of low prices of sale to the consuming public, thereby making such portable golf ball cleaning device economically available to the buying public.

Even still another object of the present invention is to provide a new and improved portable golf ball cleaning device for allowing a golf ball to be cleaned by a golfer at any location on a golf course.

Lastly, it is an object of the present invention to provide a new and improved portable golf ball cleaning device including a housing having a hollow interior. The housing has an opening therein exposing the hollow interior. The opening is dimensioned for receiving a golf ball therethrough. The housing has a plurality of bristles disposed thereon on an interior surface thereof. The hollow interior holds a quantity of a soap and water solution therein. A ball receiving portion is rotatably disposed within the hollow interior of the housing. The ball receiving portion is dimensioned for receiving the golf ball therein. The ball receiving portion is positioned within the hollow interior of the housing whereby a golf ball positioned therein will be in contact with the plurality of bristles of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
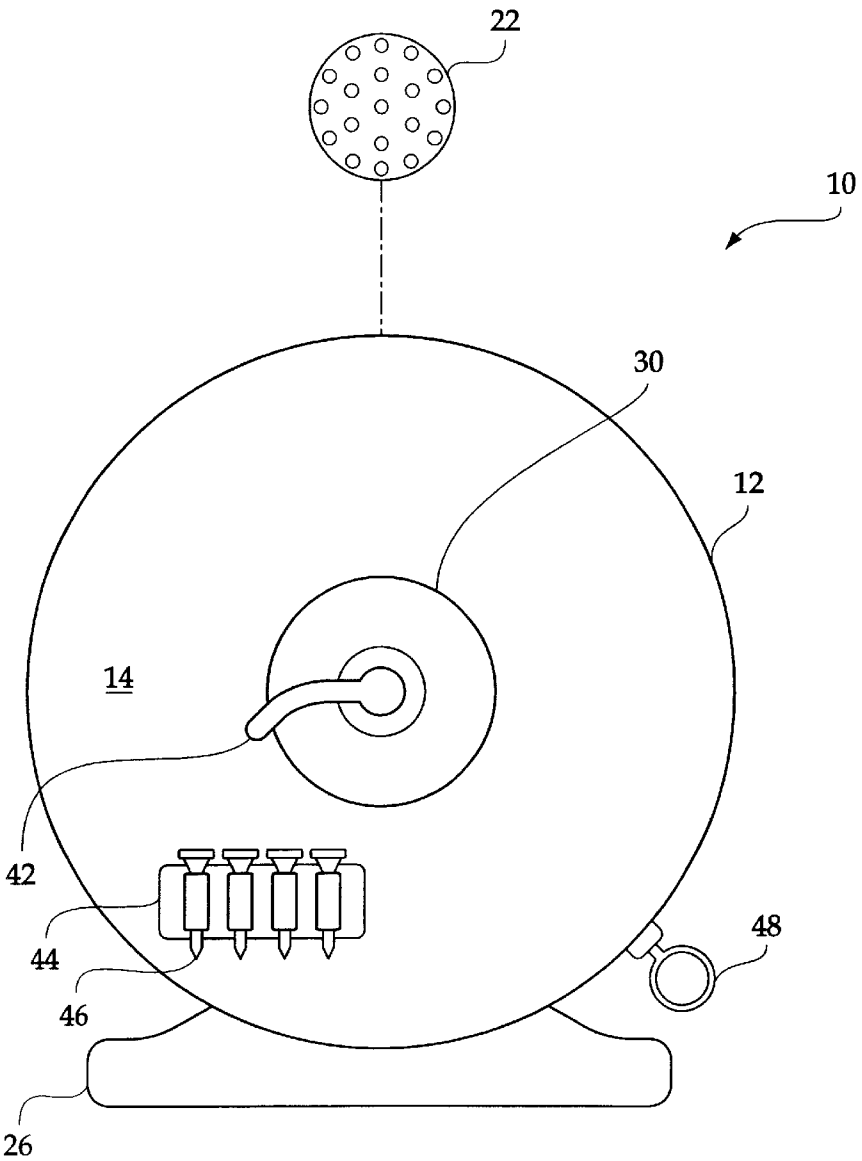
FIG. 1 is a perspective view of the preferred embodiment of the portable golf ball cleaning device constructed in accordance with the principles of the present invention.
Figure 2:
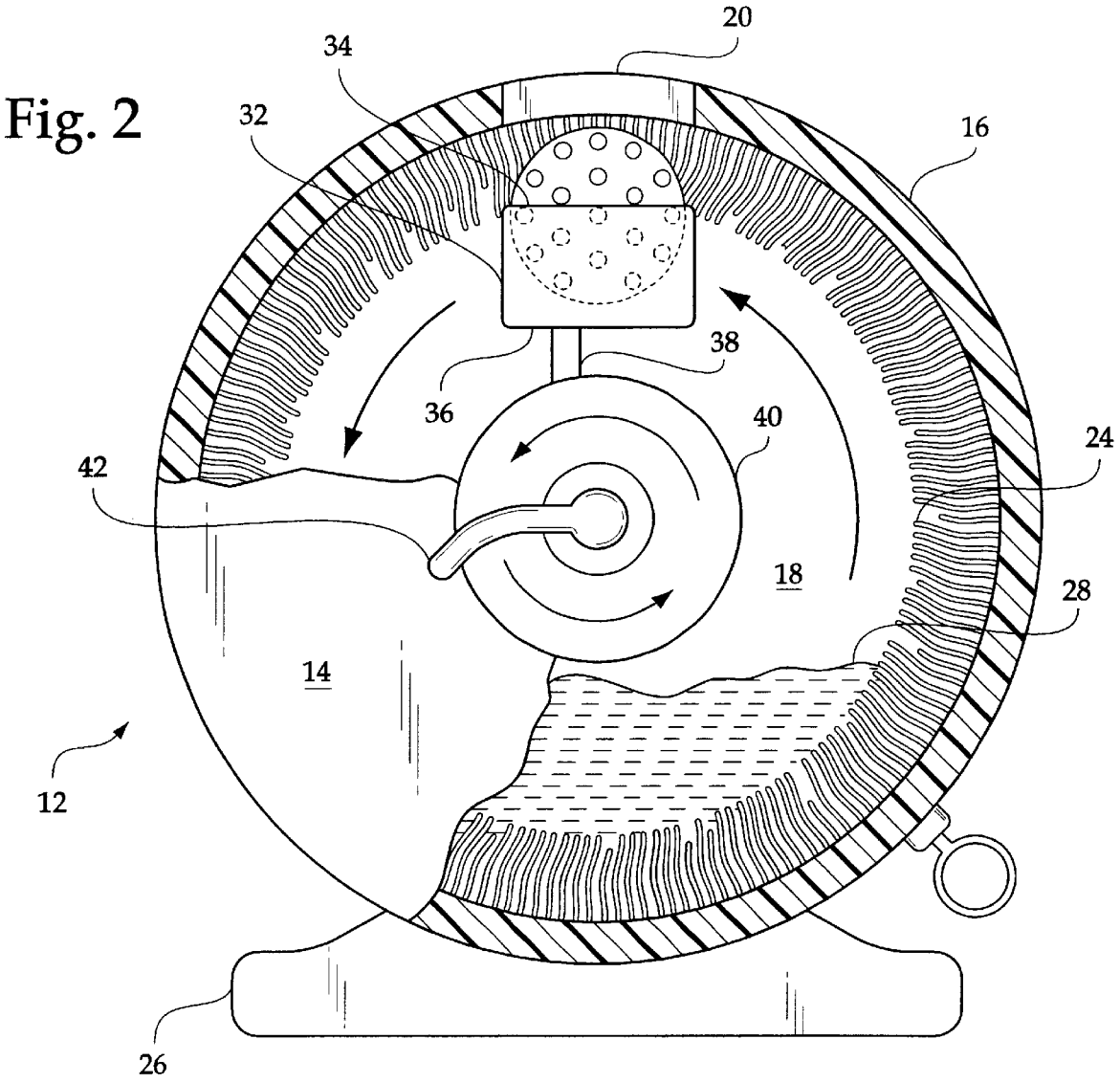
FIG. 2 is a cross-sectional view of the present invention as presented in FIG. 1.

With reference now to the drawings, and in particular, to FIGS. 1 through 2 thereof, the preferred embodiment of the new and improved portable golf ball cleaning device embodying the principles and concepts of the present invention and generally designated by the reference number 10 will be described.

Specifically, it will be noted in the various Figures that the device relates to a portable golf ball cleaning device for allowing a golf ball to be cleaned by a golfer at any location on a golf course. In its broadest context, the device consists of a housing, a ball receiving portion, a tee holding bracket, and a towel clip. Such components are individually configured and correlated with respect to each other so as to attain the desired objective.

The housing 12 has a generally circular configuration. The housing 12 has a planar front wall 14, a planar rear wall, a peripheral side wall 16 therebetween, and a hollow interior 18. The peripheral side wall 16 has an opening 20 therein exposing the hollow interior 18. The opening 20 is dimensioned for receiving a golf ball 22 therethrough. The peripheral side wall 16 has a plurality of bristles 24 disposed thereon on an interior surface thereof. The housing 12 has a base 26 secured thereto to support the housing 12 in an upright orientation. The base 26 is diametrically opposed from the opening 20 in the peripheral side wall 16. The hollow interior 18 holds a quantity of a soap and water solution 28 therein. The soap and water solution 28 preferably occupies about half of the holding capacity of the hollow interior 18. The solution 28 is typical of the kind used in standard golf ball washing machines. The housing 12 can also be provided with a clip, or other means for securement to a golf bag.

The ball receiving portion 30 is rotatably disposed within the hollow interior 18 of the housing 12. The ball receiving portion 30 includes a cup portion 32 disposed within the hollow interior 18 of the housing 12. The cup portion 32 has an open upper end 34 and a closed lower end 36. The open upper end 34 is dimensioned for receiving the golf ball 22 therein. The cup portion 32 is large enough to allow the golf ball 22 to move around thereon. The cup portion 32 is positioned within the hollow interior 18 of the housing 12 whereby a golf ball 22 positioned within the open upper end 34 thereof will be in contact with the plurality of bristles 24 of the housing 12. Note FIG. 2. The ball receiving portion 30 includes a stem portion 38 extending downwardly from the closed lower end 36 of the cup portion 32. The ball receiving portion 30 includes an axle 40 extending between the front and rear walls of the housing 12 within the hollow interior 18 thereof. The axle 40 is coupled with a free end of the stem portion 38. The ball receiving portion 30 includes a handle portion 42 disposed on the front wall 14 of the housing 12. The handle portion 42 is coupled with the axle 40 to facilitate rotation thereof. In use, the golf ball 22 is directed through the opening 20 and placed into the open upper end 34 of the cup portion 32. The handle portion 42 is then rotated whereupon the axle 40 will rotate to cause the cup portion 32 to rotate while the golf ball 22 rubbing against the bristles 24 and submerge within the solution 28.

The tee holding bracket 44 is secured to the front wall 14 of the housing 12. The tee holding bracket 44 is adapted for holding a plurality of golf tees 46.

The towel clip 48 is secured to the peripheral side wall 16 of the housing 12. The towel clip 48 is adapted for securing to a towel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable golf ball cleaning device for allowing a golf ball to be cleaned by a golfer at any location on a golf course comprising, in combination:

a housing having a generally circular configuration, the housing having a planar front wall, a planar rear wall, a peripheral side wall therebetween, and a hollow interior, the peripheral side wall having an opening therein exposing the hollow interior, the opening being dimensioned for receiving a golf ball therethrough, the peripheral side wall having a plurality of bristles disposed thereon on an interior surface thereof, the housing having a base secured thereto to support the housing in upright orientation, the base being diametrically opposed from the opening in the peripheral side wall, the hollow interior holding a quantity of a soap and water solution therein;

a ball receiving portion rotatably disposed within the hollow interior of the housing, the ball receiving portion including a cup portion disposed within the hollow interior of the housing, the cup portion having an open upper end and a closed lower end, the open upper end being dimensioned for receiving the golf ball therein, the cup portion being positioned within the hollow interior of the housing whereby a golf ball positioned within the open upper end thereof will be in contact with the plurality of bristles of the housing, the ball receiving portion including a stem portion extending downwardly from the closed lower end of the cup portion, the ball receiving portion including an axle extending between the front and rear walls of the housing within the hollow interior thereof, the axle being coupled with a free end of the stem portion, the ball receiving portion including a handle portion disposed on the front wall of the housing, the handle portion being coupled with the axle to facilitate rotation thereof;

a tee holding bracket secured to the front wall of the housing, the tee holding bracket being adapted for holding a plurality of golf tees; and a towel clip secured to the peripheral side wall of the housing, the towel clip being adapted for securing to a towel.

2. A portable golf ball cleaning device for allowing a golf ball to be cleaned by a golfer at any location on a golf course comprising, in combination:

a housing having a hollow interior, the housing having an opening therein exposing the hollow interior, the opening being dimensioned for receiving a golf ball therethrough, the housing having a plurality of bristles disposed thereon on an interior surface thereof, the hollow interior holding a quantity of a soap and water solution therein;

a ball receiving portion rotatably disposed within the hollow interior of the housing, the ball receiving portion being dimensioned for receiving the golf ball therein, the ball receiving portion being positioned within the hollow interior of the housing whereby a golf ball positioned therein will be in contact with the plurality of bristles of the housing, said ball receiving portion having a cup portion disposed within the hollow interior of the housing, the cup portion having an open upper end and a closed lower end, the open upper end being dimensioned for receiving the golf ball therein, the cup portion being positioned within the hollow interior of the housing whereby the golf ball positioned within the open upper end thereof will be in contact with the plurality of bristles of the housing.

3. The portable golf ball cleaning device as set forth in claim 2, wherein the ball receiving portion includes a stem portion extending downwardly from the closed lower end of the cup portion, the ball receiving portion including an axle extending between the front and rear walls of the housing within the hollow interior thereof, the axle being coupled with a free end of the stem portion.

4. The portable golf ball cleaning device as set forth in claim 3, wherein the ball receiving portion includes a handle portion disposed on the front wall of the housing, the handle portion being coupled with the axle to facilitate rotation thereof.

* * * * *